US009833673B2

(12) United States Patent
Perry

(10) Patent No.: US 9,833,673 B2
(45) Date of Patent: Dec. 5, 2017

(54) PITCH MARK REPAIR TOOL

(71) Applicant: Thomas Perry, Indianapolis, IN (US)

(72) Inventor: Thomas Perry, Indianapolis, IN (US)

( * ) Notice: Subject to any disclaimer, the term of this patent is extended or adjusted under 35 U.S.C. 154(b) by 0 days.

(21) Appl. No.: 15/238,300

(22) Filed: Aug. 16, 2016

(65) Prior Publication Data

US 2017/0072280 A1 Mar. 16, 2017

Related U.S. Application Data

(60) Provisional application No. 62/219,269, filed on Sep. 16, 2015.

(51) Int. Cl.
*A63B 57/50* (2015.01)

(52) U.S. Cl.
CPC ..... *A63B 57/50* (2015.10); *A63B 2209/00* (2013.01); *A63B 2210/58* (2013.01)

(58) Field of Classification Search
CPC ..... A63B 57/50; A63B 2209/00; A01B 1/15; A01B 1/165; A01B 1/24
See application file for complete search history.

(56) References Cited

U.S. PATENT DOCUMENTS 2,869,915 A * 1/1959 Good ..... A63B 57/50 122/378
3,168,150 A * 2/1965 Kappler ..... A01B 1/18 172/21
3,567,264 A * 3/1971 Baber ..... A01B 1/16 172/371
4,179,147 A * 12/1979 Mendenhall ..... A63B 57/50 294/50.7
4,846,286 A * 7/1989 McNeely ..... A63B 57/50 172/379
5,322,130 A * 6/1994 Ryden ..... A63B 57/50 172/371
5,494,279 A * 2/1996 Ahner ..... A63B 57/0037 473/386
5,730,226 A * 3/1998 Kendall ..... A63B 57/50 172/371
6,062,992 A * 5/2000 Hoyt ..... A01B 1/24 172/378
6,257,346 B1 * 7/2001 Schofield ..... A01B 1/18 172/381
8,920,265 B1 * 12/2014 Jones ..... A63B 57/0068 473/408
2004/0048694 A1 * 3/2004 Swensen ..... A63B 57/50 473/408
2004/0082410 A1 * 4/2004 Noda ..... A63B 57/50 473/408

(Continued)

*Primary Examiner* — Steven Wong

(57) ABSTRACT

A pitch mark repair tool is provided. The repair tool includes a stationary tube having a top end and a bottom end. At least one spike extends from the bottom end. A handle portion is secured to the top end of the stationary tube. A slide tube is slidably engaged with the stationary tube. The slide tube includes a bottom end having an aperture sized to fit at least one spike therethrough. A spring is disposed about the stationary tube in between the slide tube and the handle portion. The spring biases the slide tube so that the at least one spike is at least substantially disposed within the slide tube. The spike protrudes through the aperture when a pressure is applied to the bottom end of the slide tube 16 against the bias of the spring.

10 Claims, 3 Drawing Sheets

(56) References Cited

U.S. PATENT DOCUMENTS

| | | | | |
|---|---|---|---|---|
| 2004/0219997 | A1* | 11/2004 | Champion | A63B 57/50<br>473/408 |
| 2014/0352989 | A1* | 12/2014 | Weaver | A01B 1/165<br>172/1 |
| 2015/0217170 | A1* | 8/2015 | Fallon | A63B 57/50<br>473/408 |
| 2016/0121179 | A1* | 5/2016 | Fallon | A63B 57/0068<br>473/408 |

* cited by examiner

PITCH MARK REPAIR TOOL

CROSS-REFERENCE TO RELATED APPLICATION

This application claims the benefit of priority of U.S. provisional application No. 62/219,269, filed Sep. 16, 2015, the contents of which are herein incorporated by reference.

BACKGROUND OF THE INVENTION

The present invention relates to a golf tool and, more particularly, to a pitch mark repair tool.

A ball mark repair tool (also known as a pitchfork or divot tool) is used to repair a ball mark (a depression in the green where a ball has hit the ground on its approach shot). To repair a ball mark, one pushes the tool next to the mark and pushes gently inwards from all sides, loosening the compacted turf to allow rapid regrowth of grass, and then flattens the mark with the smooth flat bottom of the putter to smooth the putting surface. Most ball mark repair tools are hand tools. To use current ball mark repair tools, the golfer must bend down to the green to make the repairs. This may be difficult for senior golfers or golfers with injured backs. Also, current repair tools do not include a sand delivery features, allowing the user to aerate and top dress the divot at the same time.

As can be seen, there is a need for an improved pitch mark repair tool for golfers, professional greens keepers and maintenance personnel.

SUMMARY OF THE INVENTION

In one aspect of the present invention, a pitch mark repair tool comprises: a stationary tube comprising a top end and a bottom end, wherein at least one spike extends from the bottom end; an handle portion secured to a top end of the stationary tube; a slide tube slidably engaged with the stationary tube and comprising a bottom end comprising at least one aperture sized to fit the at least one spike therethrough; a spring disposed about the stationary tube in between the slide tube and the handle portion, wherein the spring biases the slide tube so that the at least one spike is at least substantially disposed within the slide tube, and the at least one spike protrudes through the at least one aperture when a pressure is applied to the bottom end of the slide tube.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
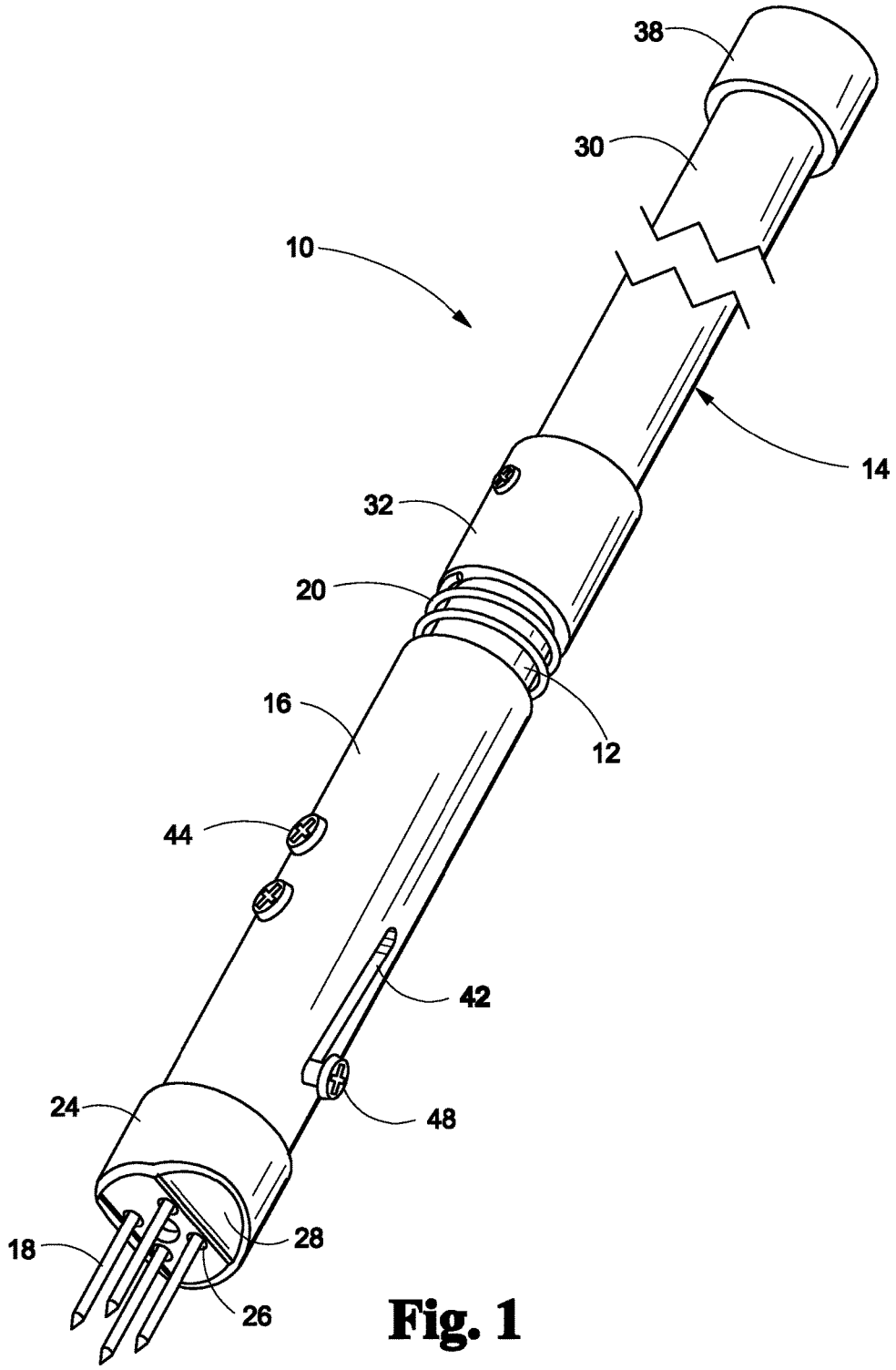
FIG. 1 is a perspective view of an embodiment of the present invention.
Figure 2:
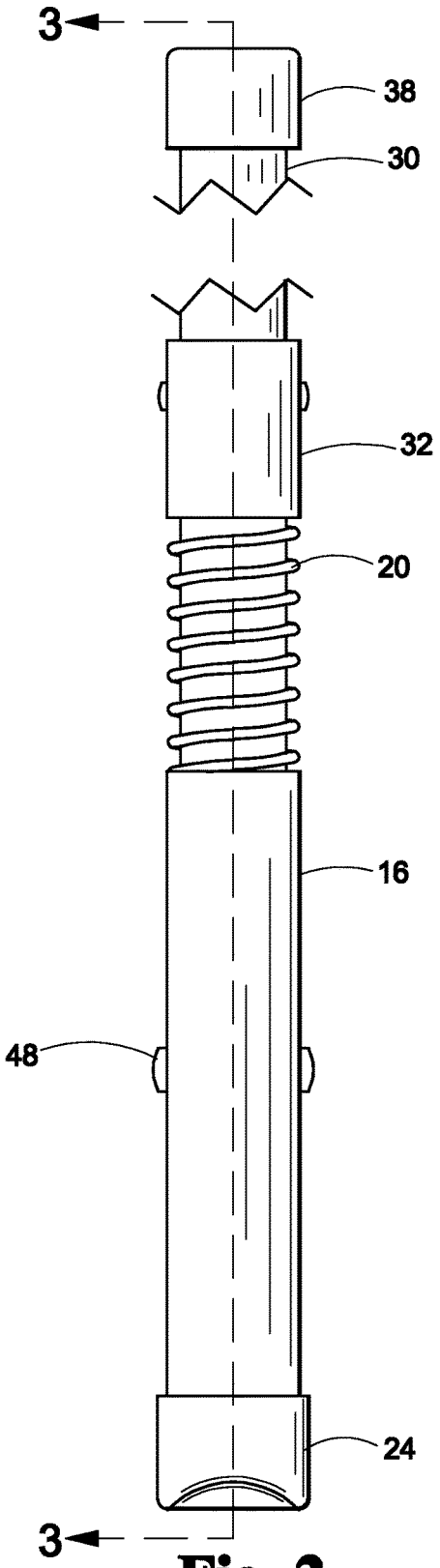
FIG. 2 is a front view of an embodiment of the present invention.
Figure 3A:
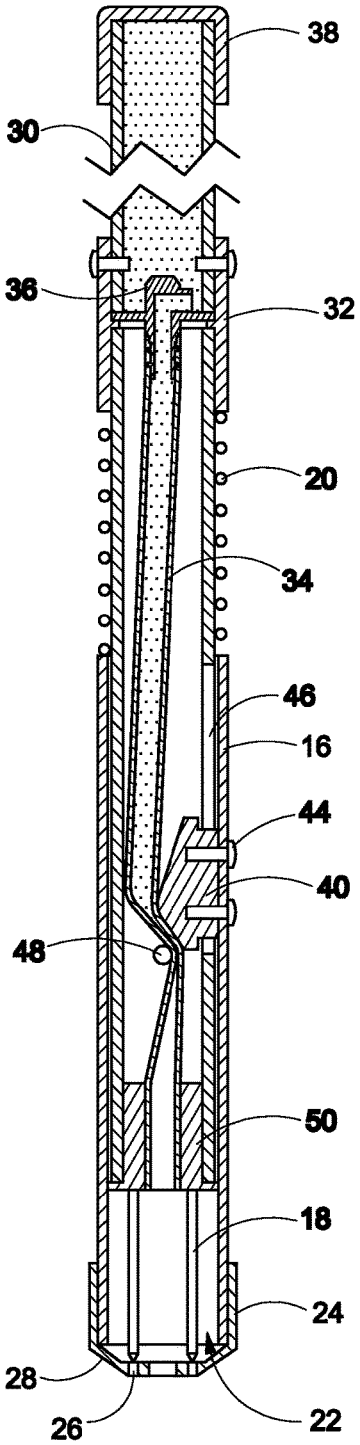
FIG. 3A is section view taken along 3-3 of FIG. 2 in a disengaged position.
Figure 3B:
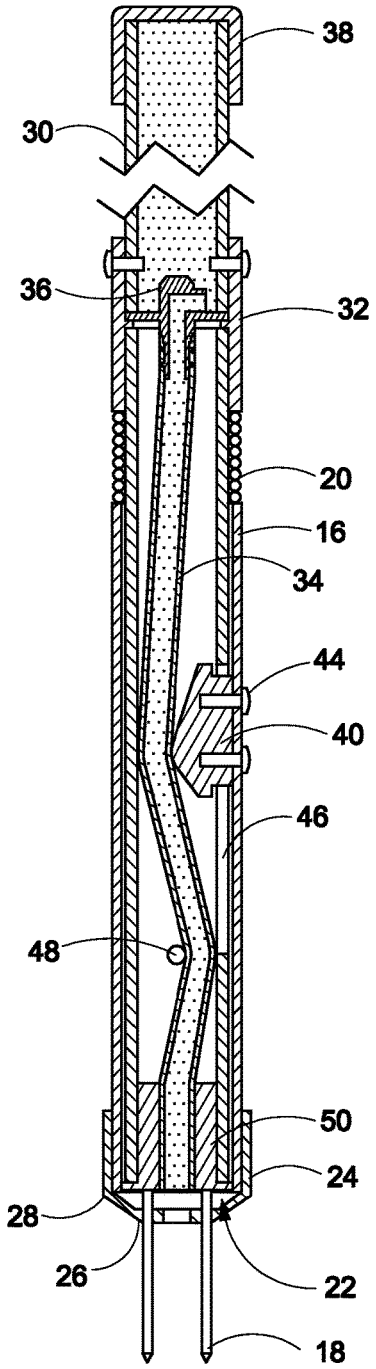
FIG. 3B is a section view taken along 3-3 of FIG. 2 in an engaged position.

Referring to FIGS. 1 through 3B, the present invention includes a pitch mark repair tool 10. The repair tool 10 includes a stationary tube 12 having a top end and a bottom end. At least one spike 18 extends from the bottom end. A handle portion 14 is secured to the top end of the stationary tube 12. A slide tube 16 is slidably engaged with the stationary tube 12. The slide tube 16 includes a bottom end having an aperture 22 sized to fit at least one spike 18 therethrough. A spring 20 is disposed about the stationary tube 12 in between the slide tube 16 and the handle portion 14. The spring 20 biases the slide tube 16 so that the at least one spike 18 is at least substantially disposed within the slide tube 16. The spike 18 protrudes through the aperture 22 when a pressure is applied to the bottom end of the slide tube 16 against the bias of the spring 20.

The at least one spike 18 may include a plurality of spikes 18 protruding from the bottom of the stationary tube 12. In certain embodiments, the present invention may include a spike support cap 50 having 4 spikes protruding therefrom. The spike support cap 50 snuggly fits within an aperture formed at the bottom end of the stationary tube 12.

The present invention may further include a bottom cap 24. The bottom cap 24 is secured to the bottom end of the slide tube 16. The bottom cap 24 includes a sidewall secured to the slide tube 16 and an end wall covering the aperture 22. The end wall includes a plurality of apertures 26 each sized to fit one of the plurality of spikes therethrough. In certain embodiments, a portion of an edge adjoining the end wall and the sidewall of the bottom cap 24 is a beveled edge 28. For example, opposing sides of the bottom cap 24 may include a beveled edge 28.

The handle portion 14 of the present invention may include an upper tube 30 secured to the stationary tube 12 by a coupler 32. The spring 20 is disposed in between the coupler 32 and the slide tube 16. In certain embodiments, a top end of the spring 20 may abut a bottom end of the coupler 32 and the bottom end of the spring 20 may abut the top end of the slide tube 16.

In certain embodiments, the present invention may also deliver sand while in use. In such embodiments, the present invention includes a sand delivery tube 34 running through the stationary tube 12 from the top end to the bottom end. In such embodiments, the bottom cap 24 may include a sand delivery aperture fluidly connected to the sand delivery tube 34. An inlet 36 may fluidly connect the upper tube 30 to the sand delivery tube 34. A top cap 38 may be removeably secured to the top end of the upper tube 30. Therefore, to reload the present invention with sand, a user may remove the top cap 38 and pour the sand into the upper tube 30 and the sand runs through the inlet 36 and into the sand delivery tube 34.

To prevent the sand from escaping the sand delivery tube 34 while the repair tool 10 is disengaged, the present invention may include a tube crimper 40 and a guide pin 48. In such embodiments, the sand delivery tube 34 may be formed of a hyperelastic material, such as rubber, silicone or other materials with a rubber elasticity. The tube crimper 40 may be fixedly secured to the slide tube 16 and slidably engage with the stationary tube 12. In such embodiments, the tube crimper 40 is secured to the inner surface of the slide tube 16 via bolts 44 and protrudes though a slot 46 formed through the stationary tube 12. The tube crimper 40 slides up and down along the slot 46 when is pressure is applied to and released from the bottom end of the slide tube 16. The tube crimper 40 includes a lobe that presses against the sand delivery tube 34.

The guide pin 48 runs through aligning apertures of the stationary tube 12 and into slots 42 formed through the slide tube 16. Therefore, the guide pin 48 may be fixedly secured to the stationary tube 12 and slidably engaged with the slide tube 16. The guide pin 48 may be disposed below the tube crimper 40. When in the initial position, sand delivery tube 34 is squeezed in between the lobe of the tube crimper 40 and the guide pin 48. When pressure is applied to the bottom end of the slide tube 16, the guide pin 48 slides downward with the stationary tube 12 along the slots 42 formed through the slide tube 16. The tube crimper 40 slides upward with the slide tube 16 along the slot 46 formed through the stationary tube 12. Since the tube crimper 40 and the guide pin 48 slide away from one another, the sand delivery tube 34 is no longer crimped between the two, and sand may run through the sand delivery tube 34 and out of the sand delivery aperture.

A method of using the present invention may include the following. Remove the cap and fill the tube with dry sand, and secure the cap back onto the upper tube. If sand is used to repair the pitch mark, the present invention may be rotated to the 'Flow' side of the tool. Hold the tool of the present invention at about a 30 degree angle for a few seconds to allow sand to flow into the chamber before pushing on the tool to engage the spikes. Push on the present invention at a 30 degree angle from perpendicular to engage the spikes from the bottom of the tool. Tilt the present invention until it is perpendicular with the ground. Then release the pressure and allow the spikes to return to their original position. This allows a small amount of sand to be released. The application of the sand and the tilting action helps to repair the damaged turf and close the indentation caused by the golf ball hitting the green. Place the present invention in a perpendicular position relative to the ground and begin pushing up and down to aerate and flatten the damaged area. If sand is not required to repair a minor pitch mark, rotate the present invention in an opposite direction of the 'Flow' side and repeat the above steps.

It should be understood, of course, that the foregoing relates to exemplary embodiments of the invention and that modifications may be made without departing from the spirit and scope of the invention as set forth in the following claims.

What is claimed is:

1. A pitch mark repair tool comprising:

a stationary tube comprising a top end and a bottom end, wherein at least one spike extends from the bottom end;

a sand delivery tube running through the stationary tube from the top end to the bottom end;

a handle portion secured to the top end of the stationary tube;

a slide tube slidably engaged with the stationary tube and comprising a bottom end comprising at least one aperture sized to fit the at least one spike therethrough;

a spring disposed about the stationary tube in between the slide tube and the handle portion, wherein the spring biases the slide tube so that the at least one spike is at least substantially disposed within the slide tube, and the at least one spike protrudes through the at least one aperture of the slide tube when a pressure is applied to the bottom end of the slide tube.

2. The pitch mark repair tool of claim 1, wherein the at least one spike is a plurality of spikes.

3. The pitch mark repair tool of claim 2, further comprising a bottom cap secured to the bottom end of the slide tube and comprising an end wall and a sidewall, wherein the end wall comprises a plurality of apertures each sized to fit one of the plurality of spikes therethrough.

4. The pitch mark repair tool of claim 3, wherein at least a portion of an edge joining the end wall and the sidewall of the bottom cap is beveled.

5. The pitch mark repair tool of claim 1, wherein the handle portion comprises an upper tube secured to the stationary tube by a coupler, wherein the spring is disposed in between the coupler and the slide tube.

6. The pitch mark repair tool of claim 1, further comprising an inlet fluidly connecting an inside of the handle portion with the sand delivery tube.

7. The pitch mark repair tool of claim 6, further comprising a top cap releasably secured to a top end of the handle portion.

8. The pitch mark repair tool of claim 1, wherein the sand delivery tube is formed of a hyperelastic material.

9. The pitch mark repair tool of claim 7, further comprising a tube crimper secured within the stationary tube and operable to restrict and release a flow through the sand delivery tube.

10. A pitch mark repair tool comprising:

a stationary tube comprising a top end and a bottom end, wherein at least one spike extends from the bottom end;

a handle portion secured to the top end of the stationary tube;

a slide tube slidably engaged with the stationary tube and comprising a bottom end forming an opening;

a bottom cap secured to the bottom end of the slide tube and covering the opening, wherein the bottom cap comprises an end wall and a sidewall, wherein the end wall comprises at least one aperture sized to fit the at least one spike therethrough, wherein opposing sides of the bottom cap are beveled forming a first flat angled surface and a second flat angled surface; and a spring disposed about the stationary tube in between the slide tube and the handle portion, wherein the spring biases the slide tube so that the at least one spike is at least substantially disposed within the slide tube, and the at least one spike protrudes through the at least one aperture of the bottom cap when a pressure is applied to the bottom end of the slide tube.

* * * * *